United States Patent [19]

McMahon

[11] Patent Number: 4,974,395

[45] Date of Patent: Dec. 4, 1990

[54] ZIPPER GUIDE AND SPREADER DEVICE FOR FORM, FILL AND SEAL MACHINES

[75] Inventor: Michael J. McMahon, Palatine, Ill.

[73] Assignee: Zip-Pak Incorporated, Northbrook, Ill.

[21] Appl. No.: 468,061

[22] Filed: Jan. 22, 1990

[51] Int. Cl.[5] ..... B65B 7/06; B65B 9/08; B31C 13/00

[52] U.S. Cl. ..... 53/551; 53/373; 493/302; 493/923

[58] Field of Search ..... 53/128, 133, 389, 410, 53/412, 450, 451, 550, 551, 552, 373; 493/302, 923

[56] References Cited

U.S. PATENT DOCUMENTS 2,720,680 10/1955 Gerow ..... 493/302 X
3,538,676 11/1970 Runo et al. ..... 53/552
4,534,159 8/1985 Kelly ..... 53/552
4,829,745 5/1989 Behr et al. ..... 53/551 X
4,829,746 5/1989 Schmidt et al. ..... 53/451
4,869,048 9/1989 Boeckmann ..... 53/551 X

*Primary Examiner*—Robert L. Spruill
*Assistant Examiner*—Beth Bianca
*Attorney, Agent, or Firm*—Hill, Van Santen, Steadman & Simpson

[57] ABSTRACT

A zipper guide and spreader device for form, fill and seal apparatus comprises a package material guiding and spreading mechanism wherein a pair of articulated members have zipper guideways. The members are hingedly connected together and one of the members is hingedly connected to a fixed support. An actuator operates the articulated members from a biased relaxed position into an articulated material-spreading position wherein the material is spread for eliminating wrinkles before edge sealing across the material below the discharge end of the forming and filling tube.

18 Claims, 2 Drawing Sheets

ZIPPER GUIDE AND SPREADER DEVICE FOR FORM, FILL AND SEAL MACHINES

BACKGROUND OF THE INVENTION

This invention relates to improvements in smoothing of bag making material in form, fill and seal machines wherein bag making film material is formed into bags filled with product after descending from a form, fill tubular nozzle toward bag sealing means.

Examples of form, fill and seal bag making and filling machines, especially relevant to the present invention are disclosed in U.S. Pat. Nos. 4,355,495 and 4,829,745, which to any extent necessary are incorporated herein by reference so that the present invention may be more succinctly disclosed herein.

The problem to which the present invention is directed is elaborately described in the aforesaid U.S. Pat. No. 4,829,745, namely, that wrinkles tend to form along the edge seal lines of the bags produced as a result of the operation of the form, fill and seal machines, wherein a tube of bag making material is, after it descends below the discharge end of the form and fill tube, sealed thereacross by seal forming means to form one side of a bag which is then filled and sealed across to form the opposite side of the bag. As disclosed in that patent, gripper means on one side of the flattened tube and a swinging arm inside the tube cooperate to maintain a flat configuration of the bag making material relative to the sealing jaw means. That arrangement, while reasonably effective, requires mechanism functioning within the filling area of the form and fill tubular nozzle, and the present invention has as one of its aims, to avoid that complication.

SUMMARY OF THE PRESENT INVENTION

An important object of the present invention is to provide a new and improved device for assuring substantially smooth bags formed on a form, fill and seal machine.

Another object of the present invention is to provide new and improved means for assuring substantial smoothness in the bags produced during operation of a form, fill and seal machine.

Still another object of the invention is to provide means which function at the outside of the bag making material for assuring smoothness in the bags produced in a form, fill and seal machine.

Yet another object of the present invention is to provide new and improved means for not only guiding zippered bag making material but also for concurrently smoothing and sealing flattened bag making material below the discharge end of a form, fill and seal machine tubular forming and filling nozzle member.

In a preferred embodiment there is provided in a form, fill and seal machine wherein package making material slidably wrapped about a forming and filling tube has a longitudinal zipper closure and is advanced by package width increments along and below the discharge end of the tube, a package material guiding and spreading device comprising a pair of articulated members having zipper guideways, and means for actuating the members between an aligned guideway relation wherein the zipper can run fairly freely through the aligned guideways during advancement of the material, and an articulated material spreading position wherein the material is spread for eliminating wrinkles before edge sealing across the material below the discharge end of the forming and filling tube.

BRIEF DESCRIPTION OF THE DRAWINGS

Other objects, features and advantages of the present invention will be readily apparent from the following description of a preferred embodiment thereof, taken in conjunction with the accompanying drawings, although variations and modifications may be effected without departing from the spirit and scope of the novel concepts of the disclosure, and in which.

DETAILED DESCRIPTION

Figure 2:
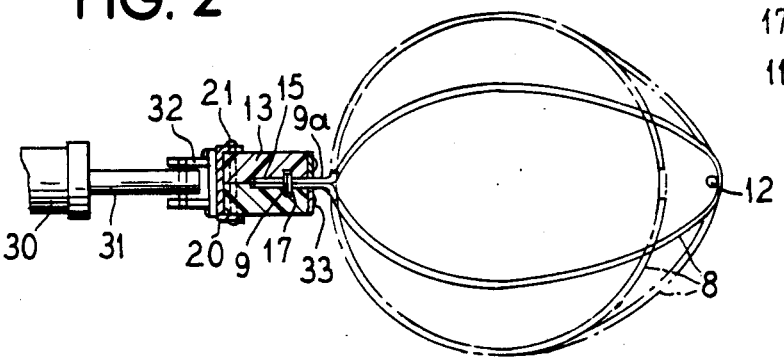
FIG. 2 is a sectional plan view taken substantially along the line II—II in FIG. 1.

A device 5 embodying the present invention is disclosed in association with the discharge end of a tubular forming and filling shute or nozzle 7 of a form, fill and seal machine. Bag or package making material 8, which for illustrative purposes is generally exagerated as to thickness in the drawings, is formed up by means, not shown, about the tube 7 in the usual fashion wherein the material is fed to the tube 7 in sheet form. Edges of the sheet are brought together in a closure 9 comprising a zipper having at least one male rib-like profile 10 along one edge and a groove like female profile 11 along the other edge and the profiles reclosably interlocked in a fin-like arrangement 9*a*. This zippered fin 9*a* provides reclosable mouth ends of bags or packages to be formed from the material 8.

At the discharge end of the tube 7 and opposite the fin 9*a*, the device 5 provides for shaping the material 8 into substantially flattened form to facilitate the package making process. To this end, the lower extremity of the tube 7 has as one part of the spreader device 5 a fixed spreader finger 12 which is located outside of the discharge passage of the tube 7 and over which the material 8 opposite the zipper 9 is guided laterally for flattening into one edge of the flattened material 8 and which edge can become the bottom ends of bags or packages into which the material is ultimately converted.

Figure 4:
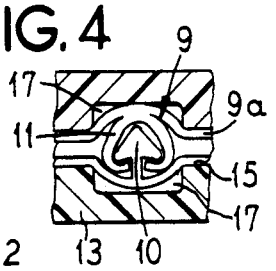
FIG. 4 is a fragmentary enlarged sectional detail view taken substantially along the line IV—IV in FIG. 1.
Figure 3:
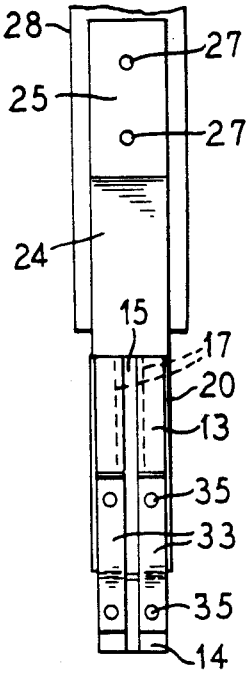
FIG. 3 is a vertical sectional detail view taken substantially along the line III—III in FIG. 1.
Figure 6:
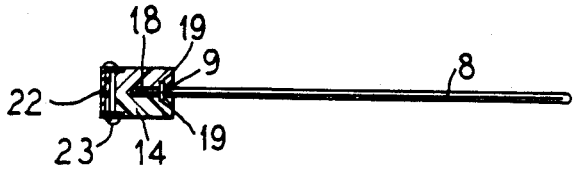
FIG. 6 is a fragmentary sectional plan view taken substantially along the line VI—VI in FIG. 5.

Opposite to the spreader finger 12, the device 5 comprises an articulated structure having complementary members 13 and 14 for guiding the zipper 9 and its fin 9*a* to maintain the tubularly formed up material 8 against drifting about its axis. In a simple, efficient arrangement, the guiding and spreader member 13 is of generally elongate form having a guideway 15 through which the zipper fin runs freely and with the substantially greater mass of the zipper accommodated at opposite sides of the zipper fin 9*a* in tracking channels 17 (FIGS. 2, 3 and 4).

While the member 14 is desirably shorter than the member 13, the member 14 has a zipper fin guideway 18, with zipper channels 19 conforming in shape to the shape of the guideway 15 and channels 17. The member 14 is preferably complementary to the lower end of the member 11 and the passage ways 15 and 18 are axially aligned.

Desirably the members 13 and 14 are made from a substantially friction free plastic material such as solid nylon which can be readily molded or machined and will present minimum frictional resistance to sliding of the material 8 and more particularly the zipper fin 9*a* through the aligned channels of the guide members during advance of the material by package forming length sections and the material spreading or flattening maneuver. To this end, each of the members 13 and 14 may be formed up as split blocks secured into respective units. For example, the split block portions of the member 13 may be secured together by a channel 20 along its back by suitable fasteners 21. Similarly the member 14 may be secured together along its back by means of a channel 22 secured in place by means of a fastener 23.

Figure 1:
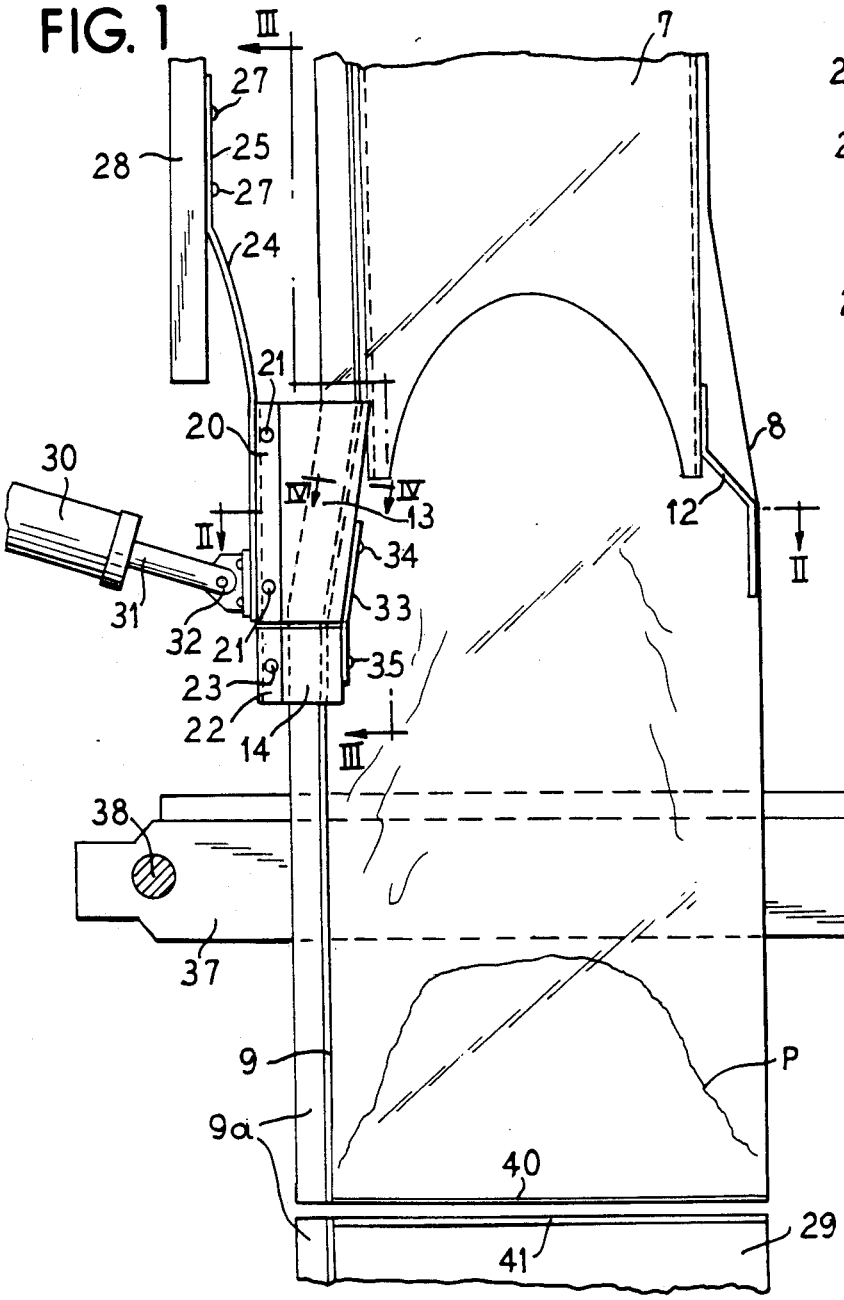
FIG. 1 is a fragmentary, more or less schematic, side elevational view of that portion of a form, fill and seal machine embodying the present invention.
Figure 5:
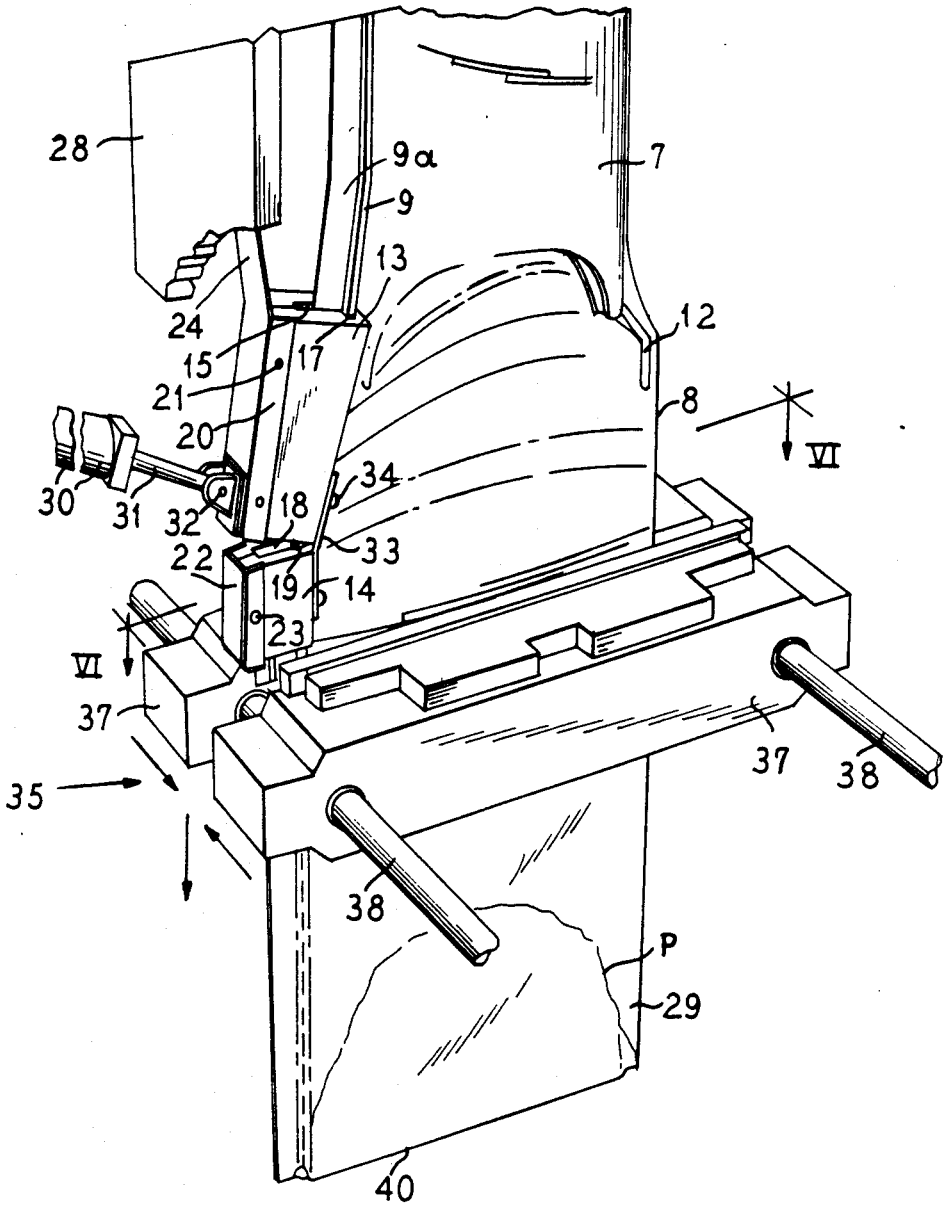
FIG. 5 is a fragmentary perspective view of the apparatus in FIG. 1 showing the guiding and spreader device in the spreading mode in contrast to the relaxed or free flow through mode in FIG. 1.

Mounting of the articulated structure of the spreader 5 is conveniently effected by hinging means comprising a resiliently flexible spring hinge arm extension 24 extending upwardly from the end of the channel 20 and terminating in an attachment pad 25 secured as by means of screws or bolts 27 to a fixed frame member 28 of the machine with which the described apparatus is associated. Resilient flexibility of the spring arm 24 need only be sufficient to permit the member 13 to be deflected from a slack or at rest position as shown in FIG. 1 for relatively free running of the zipper fin therethrough during advances of the material 8, to a tension position as shown in FIG. 5 wherein the member 13 has been pulled from the slack or at rest position laterally relative to the lower end of the tube 7 for spreading the material 8 into flattened substantially wrinkle free condition after a load of product P has been deposited in the lead bag 29 formed in the material 8.

Actuation of the member 13 is effected as by means of a pneumatic actuator 30 having a piston rod 31 connected to the lower back portion of the member 13 as by means of a knuckle 32. Through this arrangement the actuator 30 is adapted to shift the member 13 from the relaxed position shown in FIG. 1 against the bias of the spring arm 24 into the package material spreading wrinkle erasing position shown in FIG. 5.

It will be observed that such material spreading action of the member 13 causes it to tilt away from the lower end of the tube 7 and away from the opposite spreader finger 12. Therefore, to guide the zippered fin in a smooth transition from the lower outwardly tilted end of the member 13, the lower member 14 is hingedly connected to the member 13, preferably by means of spring hinge strips 33 (FIGS. 1, 3 and 5) attached to the members 13 and 14 by means of suitable fasteners 34. Thereby in the relaxed relationship of the members 13 and 14, the hinge springs 33 bias the lower member 14 toward close contiguity to the adjacent end of the member 13. On the other hand, when the upper member 13 is swung into material spreading relation as in FIG. 5, the lower member 14 by virtue of the resilient spring yielding of the spring straps 33 can follow the zipper fin 9*a* and assist in the material spreading action but remain essentially vertically disposed in its zipper fin guiding function. The spring connectors 33 automatically bias the members 13 and 14 toward one another as in FIG. 1 when the actuator 30 releases the member 13 for biasing thereof into the relaxed position by means of the spring arm 24.

Operation of the articulated members 13 and 14 is coordinated with operation of sealing and pull down means 45 comprising a pair of complementary sealing bars 37 mounted on guide rods 38 for reciprocating movement into and out of package sealing relationship. In well known manner, the sealing bars 37 move upwardly as indicated by directional arrow 39 in FIG. 1 from a position to which the package material has been pulled downwardly by the cooperating sealing bars which have also effected a bottom side seal 40 for the next succeeding bag section of the material 8 and a top side seal 41 for the immediately preceding bag 29.

During upward movement of the bars 37, they are spread apart and product P is deposited into the next succeeding bag. Further, during upward travel of the bars 37, the articulated member 13, 14 of the spreader device 5 remain in the relaxed relation assumed at the time the sealing bars 37 started to pull the material 8 downwardly. Upon reaching the top of the sealing and pull down cycle, depicted in Fig. 5, the sealing bars 37 are moved into sealing position immediately after the articulated spreader members 13 and 14 are actuated into the package material spreading orientation. Upon assuming the sealing cooperation, the bars 37 are caused to move downwardly in a material pull down action for one package width.

Coordinated with the sealing bar pull down, the articulated spreader member 13, 14 is released from the spreader mode of FIG. 5 to the relaxed mode of FIG. 1 so that the zipper 9 and fin 9*a* can travel freely through the aligned, relaxed spreader members 13 and 14.

It will be understood that variations and modifications may be effected without departing from the spirit and scope of the novel concepts of the present invention.

What is claimed is:

1. In form, fill and seal apparatus wherein package making material slidably wrapped about a forming and filling tube has a longitudinal zipper closure and is advanced by package width increments along and then below the package filling discharge end of the tube:

a package material guiding and spreading device comprising a pair of articulated members having zipper guideways; and means for actuating said members between an aligned guideway relation wherein the zipper can run freely thru the aligned guideways during advancement of the material, and an articulated material spreading position wherein the material is spread for eliminating wrinkles before edge sealing across the material below the discharge end of the forming and filling tube.

2. Apparatus according to claim 1, including a fixed spreader means on the lower end of said tube and opposite said articulated members.

3. Apparatus according to claim 1, wherein said means for actuating comprises an actuator attached to one of said articulated members.

4. Apparatus according to claim 1, wherein said members are connected in articulated relation by spring hinge means.

5. Apparatus according to claim 4, wherein one of said members in hingedly connected to a fixed support.

6. Apparatus according to claim 5, wherein the hinge connection comprises a spring arm.

7. Apparatus according to claim 1, wherein said actuating means comprises a pneumatic actuator having a piston rod attached to one of said articulated members, said articulated members being hingedly connected, and said one member being hingedly connected to a fixed support.

8. Apparatus according to claim 1, wherein said articulated members are connected by resilient hinge means operating normally for biasing said members into the aligned guideway relation.

9. Apparatus according to claim 1, wherein sid members comprise an elongate upper member and a shorter lower member, a rigid support, biasing spring hinge means connecting said upper member with said support, and means connecting said actuating means to said upper member.

10. A zipper guiding and spreading device for form, fill and seal apparatus wherein package making material slidably wrapped about a forming and filing tube has a longitudinal zipper closure and is advanced by package width increments along and then below the package filling and discharge end of the tube, comprising:

a package material guiding and spreading mechanism comprising a pair of articulated members having zipper guideways; and means for actuating said members between an aligned guideway relation wherein the zipper can run freely thru the aligned guideways during advancements of the material from the tube and an articulated material spreading position wherein the material is spread for eliminating wrinkles before sealing across the material below the discharge end of the forming and filling tube.

11. A device according to claim 10, including a fixed spreader means on the lower end of said tube and opposite said articulated members.

12. A device according to claim 10, wherein said means for actuating comprises an actuator attached to one of said articulated members.

13. A device according to claim 10, wherein said members are connected in articulated relation by spring hinge means.

14. A device according to claim 13, wherein one of said members is hingedly connected to a fixed support.

15. A device according to claim 14, wherein the hinge connection comprises a spring arm.

16. A device according to claim 10, wherein said actuating means comprises a pneumatic actuator having a piston rod attached to one of said articulated members, said articulated members being hingedly connected, and said one member being hingedly connected to a fixed support.

17. A device according to claim 10, wherein said articulated members are connected by resilient hinge means operating normally for biasing said members into the aligned guideway relation.

18. A device according to claim 17, wherein sid members comprise an elongate upper member and a shorter lower member, a rigid support, biasing spring hinge means connecting said upper member with said support, and means connecting said actuating means to said upper member.

* * * * *